United States Patent [19]

Shah et al.

[11] 4,378,225

[45] Mar. 29, 1983

[54] PROCESS FOR PRINTING OF FABRICS: DIFFUSED PRINT EFFECT

[76] Inventors: Krishnakan G. Shah; Kanaiyalal D. Pancholi; Jugdish I. Setalvad, all of Outside Jamalpur Gate, Post Box No. 12, Ahmedabad, India

[21] Appl. No.: 229,636

[22] Filed: Jan. 29, 1981

[51] Int. Cl.[3] ..... D06P 5/00

[52] U.S. Cl. ..... 8/484; 8/532; 8/543; 8/918; 8/922

[58] Field of Search ..... 8/484, 532, 543

[56] References Cited

U.S. PATENT DOCUMENTS 2,273,305 2/1942 Whitehead ..... 8/484

2,573,705 11/1951 Goldsmith et al. ..... 8/484

4,000,964 1/1977 Newton ..... 8/484

OTHER PUBLICATIONS

Webster's New World Dictionary, Second College Edition (World Publishing Co.), 1972, p. 1330.

*Primary Examiner*—A. Lionel Clingman

*Attorney, Agent, or Firm*—Bidyut K. Niyogi

[57] ABSTRACT

A process for printing of fabrics to impart a controlled diffused print effect thereon which comprises in printing the fabric with a suitable printing paste having an auxiliary agent which normally has a capillary action, said capillary action being reversed during the step of printing, drying the fabric and then subjecting the fabric to the step of fixing the dye and activation of the capillary action of the auxiliary agent.

15 Claims, 5 Drawing Figures

PROCESS FOR PRINTING OF FABRICS: DIFFUSED PRINT EFFECT

BACKGROUND OF THE INVENTION

Figure 1:
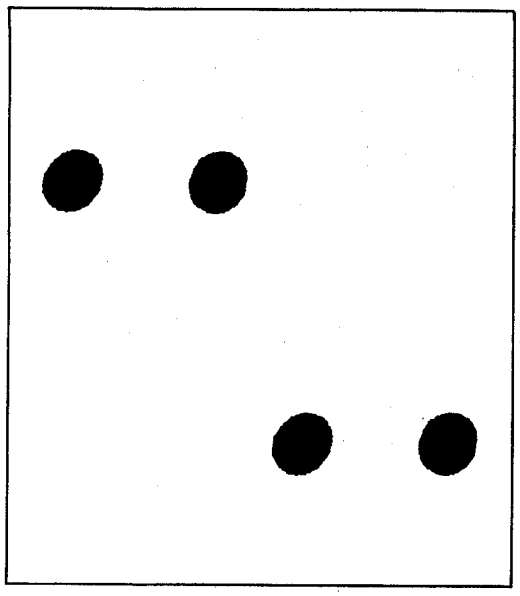

This invention relates to a process for printing of polyester, polyester blended, polyester mixed or cellulosic fabrics. In particular, this invention relates to a process for printing of polyester, polyester blended, polyester mixed or cellulosic fabrics and such as to impart a controlled diffusion effect to the designs printed thereon and to be referred as DISIKAT process.

It is generally known in the art that any print made by block, flat screen, roller or rotary screen has a sharp edge, and which is a property contrary to a diffusion effect print. Such a sharp edge to the print is imparted due to the presence of a thickening agent incorporated in the printing paste, said thickening agent being present with the specific purpose of providing a uniform depth of penetration of the dye within a confined area corresponding to the pattern. Thus, it will be apparent that to obtain a regular or a desired pattern, the presence of a thickening agent is necessary so as to obtain the regular or desired patterns. Simultaneously, and as such a thickening agent must necessarily be present in the printing paste, a controlled diffused printing effect could not hithertofore be obtained by the use of block, flat screen, roller or rotary screen.

In order to obtain such a diffused printing effect, processes are known in the art which envisage the use of special photographic and photoengraving techniques or transfer printing or printing on a wet cloth. Such processes and techniques, however, require special types of additional equipment, which again contribute towards the end-cost of the fabric. Further, the printing effect imparted to the fabric by such processes is not satisfactory and consistent.

OBJECTS OF THE INVENTION

Accordingly, a primary object of the present invention is to propose a novel process for imparting a controlled diffused print effect on polyester, polyester blended or polyester mixed fabrics or cellulosic fabrics.

An object of this invention is to propose a process for imparting a controlled diffused print effect on polyester, polyester blended, polyester mixed or cellulosic fabrics and which obviates the disadvantages associated with those of the prior art.

Still another object of this invention is to propose a process for imparting a controlled diffused print effect on polyester, polyester blended, polyester mixed or cellulosic fabrics, wherein additional equipments are no longer required.

Another object of this invention is to propose a process for imparting a controlled diffused print effect on polyester, polyester blended, polyester mixed or cellulosic fabrics and which obviates the disadvantages associated with those of the prior art.

Further objects and advantages of this invention will be more apparent from the ensuing description.

DESCRIPTION OF THE INVENTION

According to this invention there is provided a process for imparting a controlled diffused print effect on polyester, polyester blended or polyester mixed fabrics consisting of pure or blended spun polyester yarns at least in the warp or weft, printing the said fabric with a printing paste containing at least a suitable known disperse dyestuff for polyester only, a known thickening agent and an auxiliary agent having normally a capillary action and further also capable of dissolving a part of the dyestuff, said step of printing being effected thereby reversing the normal capillary action of the auxiliary agent, drying said fabric and, thereafter, subjecting the fabric to a step so as to cause an activation of the capillary action of said auxiliary agent and simultaneously fixing the dye to the fabric, followed by the usual washing, which gave the desired effect on the fabric.

Further according to this invention there is provided a process for imparting a controlled diffused print effect on fabrics consisting of cellulosic fibers, printing the said fabric with a printing paste containing suitable known reactive dyestuff for said fibers, a known thickening agent and an auxiliary agent having normally a capillary action and further also capable of dissolving a part of the dyestuff, said step of printing being effected thereby reversing the normal capillary action of the auxiliary agent, drying said fabric and, thereafter, subjecting the fabric to a step so as to cause an activation of the capillary action of said auxiliary agent and simultaneously fixing the dye to the fabric, followed by the usual washing, which gave the desired effect on the fabric.

It is generally known that polyethylene glycol-400 or oleic acid, which are by way of example two of the auxiliary agents that may be employed in the process of the present invention, have a capillary action, and that fabrics or yarns are capable of transporting liquids containing polyethylene glycol-400 or oleic acid. Though such a capillary action of polyethylene glycol and oleic acid is known in the art, the utilization of such property in the art of printing of fabrics was not hithertofore known. Furthermore, it was similarly hitherto not known that such a capillary action could be utilized in the printing of fabrics so as to impart a controlled diffused printing effect. It has now been found that a controlled diffused printing effect can be imparted by utilizing such a capillary action of an agent such that when the printing paste is applied to the fabric the capillary action of the agent is reversed, and that only during the step of fixation, the agent is activated such as to exhibit the capillary property.

In accordance with a particular aspect of the present invention, it was observed that the diffused printing effect was only in the direction of spun polyester or spun polyester blended yarns. If the fabric is woven from spun polyester or spun polyester blended yarns along both warp and weft, such a controlled diffused print effect was observed in both the directions of the fabric. However, if the spun polyester yarn or spun polyester blended yarn is provided only along the weft or warp direction, a controlled diffused print effect was imparted in that direction of the fabric having the pure or blended spun yarn i.e. if the spun polyester yarn or spun polyester blended yarn is used only in weft, then the controlled diffused printing effect was also selectively only in the weft direction and not in the warp direction.

In the instance of a fabric consisting only of cellulosic fibres, a diffused print effect was observed in both the weft and warp directions.

In accordance with this invention, the printing of the fabric is effected with a printing paste containing at least suitable disperse dyes for polyester only, a thickening agent and a auxiliary agent. The auxiliary agent is selected from the group consisting of oleic acid, polyethylene glycol having a molecular weight between 200 to 400, dibutyl butyl phosphonate, diethylene glycol and 2-anilino-ethanol used singularly or in any combination. Referring specifically to polyethylene glycol, the polyethylene glycol has preferably a molecular weight of 400. However, tests and experiments have shown that a polyethylene glycol having a molecular weight of 200 to 400 also exhibit such a controlled diffused print effect. Such an auxiliary agent may be present in a concentration of about 2 to 12 percent, and preferably between 5 to 12 percent, by weight of the printing paste. Reference is made herein to a particular concentration of the auxiliary agent employed in the process of this invention. Experiments carried out using polyethylene glycol with a molecular weight of 400 and a concentration of 5% show definite controlled diffused print effect on a fabric and which has distinct improved characteristics in comparison with those obtained by the processes of the prior art. However, simultaneously, it is to be understood that the present invention is not restricted to such a particular concentration, as other concentrations also impart a controlled diffused print effect. The concentration of the auxiliary agent is dependent on the type of the disperse dyestuff and the extent or length required of the diffused print pattern. Accordingly, such a reference to a particular concentration is only to examplify the teachings of the present invention and is not intended to be construed in a restrictive manner.

It has been found that at the time of printing and drying, the auxiliary agent remains thoroughly mixed with the thickening agent and until then it carries a very sharp print. Thus, one of the aspects of the process resides in applying the printing paste to the fabric, wherein the normal capillary action of the auxiliary agent is reversed. However, when the fabric is subjected to the step of wet high pressure steaming, the auxiliary agent, which has already dissolved some of the dyestuff from the printing paste, separates cut from the main thickener and travels along the path of capillary of the spun yarn to a distance depending upon the concentration and type of the auxiliary agent, condition of said wet steaming and characteristics of the individual dyestuff and fabric used. Such a process provides a controlled diffused print effect on the fabric.

In accordance with yet another embodiment of this invention, such a process can be applied to a fabric, consisting of spun blended yarns of polyester and cellulosic fibres provided along the weft and/or wrap, printing the said blended fabric with said printing paste and in a manner as described hereinabove, and such that the auxiliary agent does not exhibit any capillary action, thereafter subjecting the fabric to the step of fixation of the dyestuff and simultaneously activating the auxiliary agent to exhibit its normal capillary action, and finally removing the cellulosic fibres. Such a removal of the cellulosic fibres can be effected, for example, by the treatment with dilute sulphuric acid.

However, and in accordance with yet another embodiment, the cellulosic fibres need not be removed from said fabric. Thus, in the instance of a fabric consisting of spun blended yarns of polyester and cellulosic fibres, and where the cellulosic fibres are not subsequently removed from the fabric, the process is similar to that as described hereinabove. However, in such an instance the printing paste includes suitable reactive dyes for the cellulosic fibres and suitable disperse dyestuff for the polyester. In such an instance, the cellulosic fibres also exhibit a controlled diffused print effect.

In accordance with yet another embodiment of this invention the fabric can consist of a pure polyester spun yarn in warp or polyester blended yarn with cotton, viscose or wool in either warp or weft of the fabric.

Still further, the fabric can consist of a spun polyester yarn in warp and a yarn selected from cotton, silk, viscose or wool in weft or vice versa.

One of the advantages derived by the process of the present invention is that of economy in the designs and its engraving in as much as this technique gives different effects with the same design by changing the auxiliary, substrate and steaming condition.

The following examples illustrate the invention, but are not to be construed as limitative:

EXAMPLE 1

A polyester fabric, having weight as 56.4 gms per square meter and cloth construction as under:

Warp yarn: 90s Cotton count spun from 100 p.c. polyester fibres.

Weft yarn: 76/36-texturized polyester filament.

Visible ends per inch: Warps 84; Weft 72 was desized, scoured, heat-set, singed, bleached, dried and printed on an automatic screen printing machine with disperse colour, Palanil Black GEL (12 p.c.) (of BASF, Ludwigshafen, West Germany) using the following recipes A and B.

| Printing Recipe. | A | B |
|---|---|---|
| (i) Thickener (Gum Indalca AGBV) 6% paste. | 81 parts | 81 |
| (2) Disperse Dyestuff | 6 to 12 parts | 6 to 12 |
| (3) Polyethylene Glycol - 400 | Nil | 5 |
| (4) Ekaline FFS | 1 parts | 1 |
| (5) Acetic Acid. | 0.234 parts | 0.224 parts |
| (6) Sodium Hexametaphosphate | 0.112 parts | 0.112 parts |
| (7) Citric Acid. | 0.056 parts | 0.056 parts |
| (8) Water | Balance to make a total of 100 parts in A & B. | |

Figure 2:
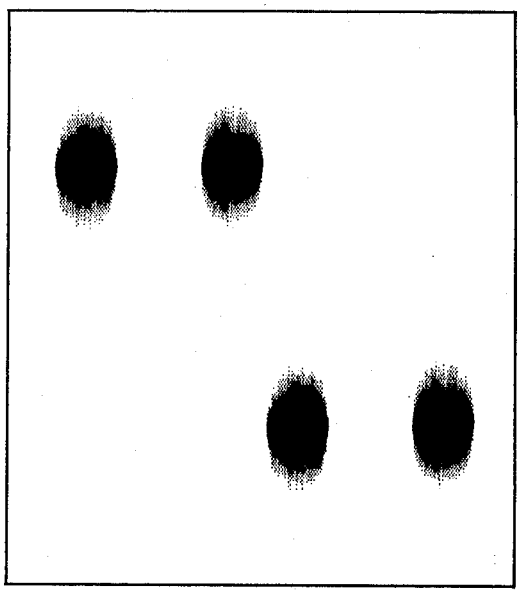

Two fabric samples were printed with recipes A&B separately, dried and then subjected to high pressure wet steaming (27 lbs/sq. inch) for 30–40 minutes in a star ager under the same conditions, to fix the disperse dye. The samples, after steaming were washed thoroughly, dried and then it was found that sample, printed with recipe A (without polyethylene glycol-400) did not show any diffused print effect, whereas a controlled diffused print effect was obtained in the sample printed with recipe B (containing polyethylene glycol-400) and as illustrated in FIGS. 1 and 2 respectively of the accompanying drawings.

EXAMPLE 2

A polyester dress material, having weight as 69.2 gms per square meter and construction as under:

Warp yarn-75s c.c. spun 100 p.c. Polyester yarn.

Weft yarn-Filament polyester yarn 76/34/150.

Visible ends per inch: Warp-88; Weft-88 was prepared and then printed with the paste B, containing polyethylene glycol-400 5 p.c. and disperse colour Resolin Red BLS, 6 percent (of Bayer AG, Leverkusen, West Germany). The fabric, after printing was dried and then subjected to high pressure wet steaming to fix the disperse dye and then thoroughly washed and dried.

Controlled diffused print effect was observed in warp direction i.e. along the direction of the spun yarn.

EXAMPLE 3

A polyester fabrics, having 100 p.c. spun polyester yarn both in warp and weft directions and construction as under:

Warp: 45s c.c. spun polyester yarn.

Weft: 45s c.c. spun polyester yarn.

Visible ends/inch: Warp-84, weft-84 was prepared and then printed using printing recipe B and having disperse colour Resolin Brown RS (of Bayer AG, Leverkusen, West Germany) (6 percent). The fabric after printing was given wet steaming treatment under pressure as before, washed and then dried. It was observed that the controlled diffused print effect was obtained both in warp and weft directions.

EXAMPLE 4

A polyester fabric, having spun polyester yarn in warp and filament yarn in weft, as described in Example 1, was desized, scoured, heat-set, bleached and then printed as per recipe B in Example 1, using Resolin Brown RS (6%) as disperse dyestuff, but with the following variations in using polyethylene glycols. The results obtained vary with the type and concentration of polyethylene glycols used.

| Type of polyethylene glycol used. | Concentration of PEG in the paste as percent. | | | | | |
|---|---|---|---|---|---|---|
| | A1 | A2 | A3 | B1 | B2 | B3 |
| PEG - 200 | 2.5 | 5 | 10 | — | — | — |
| PEG - 400 | — | — | — | 2.5 | 5 | 10 |
| Controlled diffused print effect obtained on fabric | V.Slight | Slight to medium | Good but choice of dyestuff is limited. | Slight | Good | Good (too much unsuitable for effect. |

The use of Polyethylene glycol-600 did not give satisfactory diffused print effect on the fabric.

The following chart also shows the comparative suitability of some of the disperse dyes, from various manufacturers used for obtaining the controlled diffused print effect on the fabric described under Example 1.

| No. | Name of the disperse dyestuff and the manufacturer. | Degree of controlled diffused print effect. V. Good | Good | Poor |
|---|---|---|---|---|
| 1. | Samaron Brill.Blue BL (Farbwerke Hoechst AG, Frankfurt (M), West Germany. | | | ✓ |
| 2. | Dispersel Blue D2R 'Imperial Chemical Industries, Dyestuff Division, Manchester, England) | ✓ | | |
| 3. | Samaron Brill Orange H4R (Farbwerke Hoechst AG Frankfurt (M) W.Germany) | | | ✓ |
| 4. | Duranol Blue T2R Grains. (Imperial Chemical Industries, Dyestuff Division, Manchester, England) | | ✓ | |
| 5. | Palanil Orange G. (Badische Anilin & Soda-Fabrik AG. Ludwigshafen, West Germany) | | ✓ | |
| 6. | Foron Grey S4GL Powder U/D. (Sandoz Ltd. Basle, Switzerland) | ✓ | | |
| 7. | Resolin Red FB (Farbenfabriken Bayer AG. Leverkusen West Germany) | | | ✓ |
| 8. | Foron yellow ERGEL (Sandoz Ltd. Basle, Switzerland) | | | ✓ |
| 9. | Samaron Brill Pink HGG (Farbenfabriken Bayer AG, Leverkusen, West Germany) | | | ✓ |
| 10. | Resolin Red Violet FBL. (Farbenfabriken Bayer AG, Leverkusen, West Germany) | | | ✓ |
| 11. | Dispersol Violet C4R.(Imperial Chemical Industries, Dyestuff Division, Manchester, England) | ✓ | | |
| 12. | Samaron Violent HFRL (Farbewerke Hoechst AG, Frankfurt (M) West Germany) | | | ✓ |
| 13. | Samaron violet 4RS Powder (Farbwerke Hoechst AG, Frankfurt (M) West Germany) | | | |
| 14. | Resolin Brill Red BLS (Farbenfabriken AG, Leverkusen, West Germany) | ✓ | | |
| 15. | Foron Scarlet S3GEL (Sandoz Ltd, Basle, Switzerland) | | ✓ | |
| 16. | Sereline Grey GR.(The Vorkshire Dyeware & Chemical Co. Ltd, Leads, England) | ✓ | | |
| 17. | Foron Yellow Brown S2RFL (Sandoz Ltd, Basle, Switzerland) | ✓ | | |
| 18. | Dispersol Red CB (Imperial Chemical Industries, Dyestuff Division, Manchester, England) | | ✓ | |
| 19. | Resolin Brown RS (Farbenfabriken Bayer AG, Leverksen West Germany) | ✓ | | |
| 20. | Palanil Gold Yellow GG (Badische Anilin & Soda-Fabrik AG, Ludwigshafen, West Germany) | | ✓ | |
| 21. | Dispersol Black BT (Imperial Chemical Industries Dyestuff Division, Manchester, England) | ✓ | | |
| 22. | Foron Navy S2GL (Sandoz Ltd, Basle, Switzerland) | ✓ | | |

EXAMPLE 5

A polyester-cotton fabric having weight as 71 gms per sq. meter and construction as:

Warp yarn: 58s Polyester-cotton (67:33) blended spun yarn

Weft yarn: 80/34/Texturised polyester filament yarn.

Visible ends per inch warp—84; weft—72. was desized, scoured, heat-set, singed, bleached, dried and then printed with a paste having Resolin Brown RS (of Farbenfabriken Bayer AG, Leverkusen, West Germany)(6%) as a disperse dyestuff in recipe B of Example 1, using Polyethylene glycol 400 (5 p.c.) and then after drying the print was fixed by wet-steaming under pressure as before; the fabric after washing was treated with dilute sulphuric acid (70–75% w/w) at 25°–35° C. for about one hour and thoroughly washed with water to remove the residual acid on the fabric. The fabric showed a controlled diffused print effect in the direction of warp yarn.

EXAMPLE 6

A polyester fabric, with weight per sq. meter as 58 gms and construction as under:

Warp: 90s c.c. 100 spun polyester yarn.

Weft: 80/34 Texturised polyester filament yarn.

Visible end per inch: Warp—84; Weft—72. was prepared as before and then printed with the recipe B of Example 1 using Polyethylene Glycol-400 (5% using the mixture of the following mixture of disperse dyestuffs, in proportion 1:1:1 in the printing paste.

| | |
|---|---|
| Resolin Red BLS (Farbenfabriken Bayer AG (West Germany). | 2% |
| Duranol Blue T2R.(I.C.I, (England) | 2% |
| Palanil Golden Yellow GG. (B. A. S. F. West Germany) | 2% |

The fabric after printed with the above colours given high pressure wet steaming treatment as before. The fabric after washing and drying showed a controlled diffused print effect, the degree of diffusion effect depending on the nature of the individual dyestuffs, thus, giving a multi-coloured controlled diffused print effect on the fabric.

EXAMPLE 7

The polyester fabric, having construction and weight as described in Example 1 was given a pretreatment as before and then printed on an automatic screen printing machine using the printing recipe with polyethylene glycol-400 (5%) in the printing paste as described in Example 1 and using Palanil Black GEL (12 pc.) B.A.S.F. West Germany a disperse colour. The print on the fabric was fixed as under using different methods of fixation.

| No. | Method | Result. |
|---|---|---|
| 1. | High temperature steaming. | Not suitable. |
| 2. | Thermosoling method by dry heat fixation (190-200° C.; 1 minute) | Not suitable. |
| 3. | High-pressure steaming without water in the tank. | Suitable. But degree of controlled diffused print effect is very much limited. |
| 4. | High pressure steaming with water in the tank (wet steaming). | More suitable; giving good controlled diffused print. |

The fabric after thermofixation by the above four methods was each washed separately and then dried to observe the degree of diffused print effect by the individual method. It was noted that method No.(4), gave a good controlled diffused print effect on the fabric.

EXAMPLE 8

A polyester fabric dress material, having weight 66.4 gms. per sq. meter and construction as under:

Warp yarn: 80s spun 100 p.c. polyester yarn.

Weft yarn: Filament polyester yarn 88 denier.

Visible ends per inch: Warp—194; Weft—89. was pretreated as before and printed with the paste (A) and (B) containing oleic acid (10 pc.), instead of Polyethylene Glycol-400 as in the printing recipe and disperse colour viz. 'Intrasil' Navy Blue HRS (8 p.c.) (Crompton & Knowles Corporation, U.S.A.). The printed fabric was dried and then subjected to high pressure wet steaming to fix the disperse dyes and the thoroughly washed and dried. A controlled diffused effect was observed in the sample printed with (B) recipe, in the direction of the spun yarn. Sample (A) did not show any diffused effect.

| | Printing Recipe. | (A) Parts. | (B) |
|---|---|---|---|
| (1) | Thickener (Gum Indalca AGBV, 6% Paste). | 76 parts. | 76 |
| (2) | Disperse dyestuff | 8-12 parts. | 8-12 |
| (3) | Oleic Acid | Nil parts. | 10. |
| (4) | Ekaline FFS | 1 parts. | 1 |
| (5) | Acetic Acid. | 0.224 parts. | 0.224 |
| (6) | Sodium Hexameta phosphate | 0.112 parts. | 0.112. |
| (7) | Citric Acid. | 0.056 parts. | 0.056. |
| (8) | Water | Balance to make a total of 100 parts in (A) & (B). | |

The following disperse dyes were studied to study the effect of controlled diffused print effect using oleic acid (10 p.c.):

| No. | Name of disperse dyestuff and the manufacturer. | Degree of diffused effect. V. Good. | Good. | Poor |
|---|---|---|---|---|
| 1. | Intrasil Red FTS. (Crompton & Knowles Corporation Charlotte, U.S.A.) | | | ✓ |
| 2. | Palanil Gold Yellow GG. (Badische Anilin & Soda-Fabrik AG, Ludwigshafen, West Germany) | | | ✓ |
| 3. | Intrasil orange 2RA (Crompton & Knowles Corporation, Charlotte, U.S.A.) | | | ✓ |
| 4. | Foron Orange ERL Powder U/D 2% (Sandoz Ltd, Basle, Switzerland). | | ✓ | |
| 5. | Seraline yellow 7GLS (the Yorkshire Dyewar & chemical Co. Ltd, Leeds, England) | ✓ | | |
| 6. | Foron Brill Violet EBLN Grains. (Sandoz Ltd, Basle, Switzerland) | ✓ | | |
| 7. | Intrasil Navy Blue HRS (Crompton & Knowles Corporation, Charlotte, U.S.A.) | ✓ | | |
| 8. | Dispersol Rubine BT (Imperial Chemical Industries Dyestuff Division, Manchester, England) | ✓ | | |
| 9. | Foron Scarlet E2GEL. (Sandoz Ltd, Basle, Switzerland) | ✓ | | |
| 10. | Seraline Brown 3BLS (The Yorkshire Dyeware & Chemical Co. Ltd, Leeds, England) | ✓ | | |
| 11. | Foron Grey S4GL Powder U/D. (Sandox Ltd, Basle, Switzerland) | ✓ | | |

EXAMPLE 9

Polyester blended fabrics were made having the following constructions:

(i) Warp yarn: 58s Polyester-Cotton (67:33) blended yarn.

Weft yarn: 58s 100% Cotton yarn.

Visible ends per inch: Warp—80; Weft—72.

(ii) Warp yarn: 45s 100% polyester spun yarn.

Weft yarn: 40 den. Silk filament.

Visible ends per inch: Warp—88, Weft—100.

(iii) Warp yarn: 45s polyester 100% spun yarn.

Weft yarn: 100s Cotton yarn.
Visible ends per inch: Warp—88, Weft—40.
(iv) Warp yarn: 18s 100% Cotton yarn.
Weft yarn: 2/45s 100% spun polyester yarn.
Visible ends per inch: Warp—76, Weft—64.
(v) Warp yarn: 2/32s Polyester-Viscose (67:33) spun yarn.
Weft yarn: 14s cotton yarn.
Visible ends per inch: Warp—44, Weft—40.
(vi) Warp yarn—2/32 Polyester: Wool (55:45)
Weft yarn—17s Polyester: Wool (55:45)
Visible ends per inch: Warp—64, Weft: 48.

The above samples were heat set, scoured, bleached, dried and then printed with paste having Sereline Brown 3 BLS, 6% p.c. (of The Yorkshire Dye Ware, & Chemical Co. Ltd., Leeds, England) or any other suitable disperse dyestuff in recipe B of Example 1, using ether polyester glycol 400 (5 p.c.) or oleic acid (10 p.c.) on weight of printing paste as in Example 8. The printed fabric was dried, and the print was fixed by wet steaming process under pressure as before. The fabric was finally washed thoroughly and dried.

EXAMPLE 10

The following two fabric samples, with construction as described under (A) and (B), were desized, scoured, heat set, singed, bleached and printed as described under experiments (i), (ii) and (iii).

| (A) | (B) |
|---|---|
| Warp: 50s cc.spun yarn. Polyester: Cotton (50:50) | Warp: Spun 100 pc. Polyester yarn 50s c.c. |
| Weft: 50s cc.spun yarn. Polyester; Cotton (50:50) | Weft: 100 p.c. 50s cotton yarn. |
| Visible ends per inch: Warp: 80 Weft: 80 | Visible ends per inch: Warp: 80 Weft: 80 |

(i) Both the above samples (A) & (B) were printed with printing recipe as in Example 1, with a 6 p.c. colour of Disperse Brown 3LS (or Yorkshire Dyeware and Chemical Co. Ltd, Leeds, England) and Polyethylene glycol-400 (5 p.c.) in the printing paste. The printed fabric after drying was subjected to a high pressure steamer (27 lbs/sq.inch) with wet high pressure steaming for 30–40 minutes in a star ager to fix the disperse dyestuff. The diffused print effect was noted.

(ii) The above cloth samples (A) and (B) were also printed using suitable reactive colours, with the following recipe, using polyethelene glycol 200 (5 p.c.).

| Printing Recipe. | |
|---|---|
| (1) Thickener (Gum Indalca AGBV 6% Paste) | 75 parts. |
| (2) Urea. | 10 parts. |
| (3) Polyethylene glycol - 200 | 5 parts. |
| (4) Ekaline FFS (of Sandoz Ltd). | 1 parts. |
| (5) Procion Orange H2R. | 3.5 parts. |
| Procion Red H8B. | 0.5 parts. |
| Procion Blue HGR. | 1.0 parts. |
| (All of I. C. I. England). | |
| (6) Water rest to make total 100 parts. | |

Sodium bicarbonate (2 parts) is added to the above paste at the time of printing.

The printed fabric after drying was wet pressure steamed, then washed, and noted for the diffused print effect.

(iii) The above two fabric samples were also printed using disperse and reactive colours, by mixing 1:1 part of printing paste of experiment (i) and of printing paste used in Experiment (ii). The fabrics, after printing was wet high pressure steamed to fix the print and the following observation was noted for diffused print effect.

Figure 3:
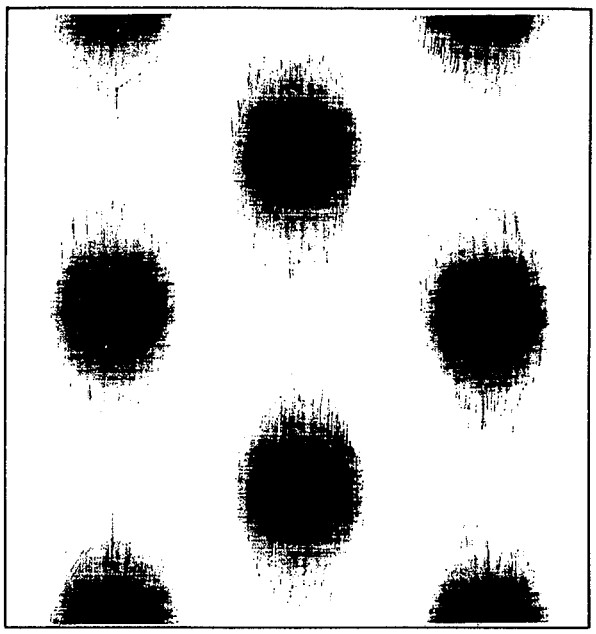
Figure 4:
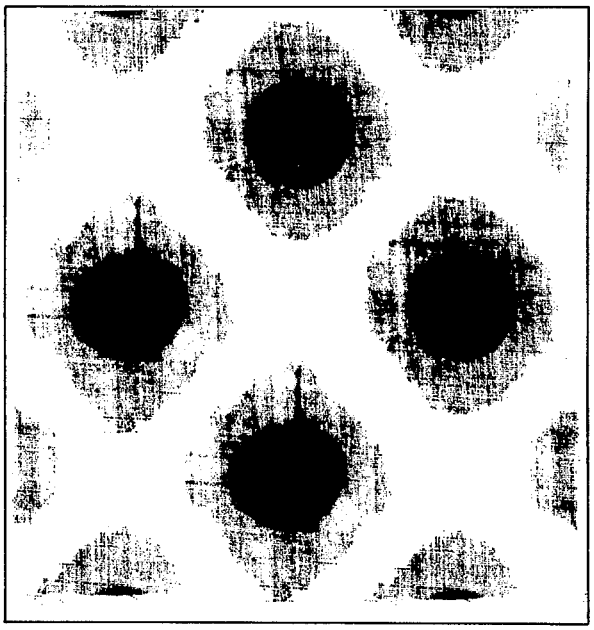
Figure 5:
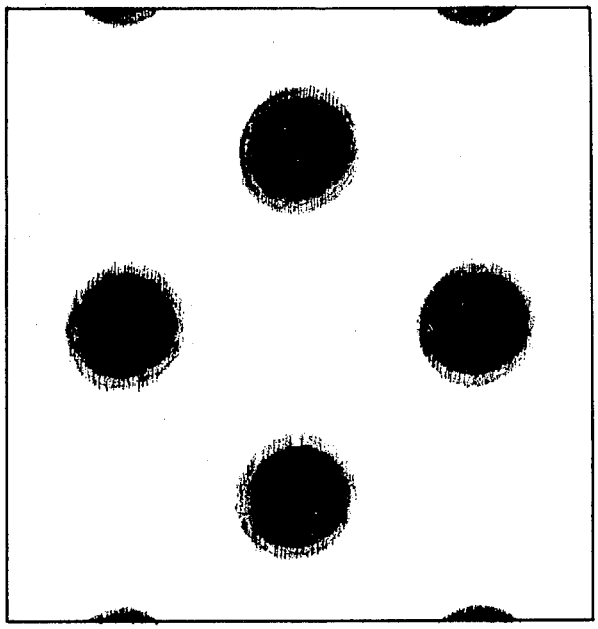

| Fabric Sample | Diffused print effect. |
|---|---|
| A | Diffused print effect was seen both in warp and weft directions of the fabric in experiments (i), (ii) and (iii) and as shown in FIGS. 3 to 5 respectively. |
| B | Diffused print effect was observed in warp direction only, in Experiment (i), weft direction in Experiment (ii) and both in warp and weft direction in Experiment (iii). |

EXAMPLE 11

A cotton fabric sample having construction as
Warp: $80^s$ c.c.
Weft: $80^s$ c.c.
and visible ends per inch: Warp 76; Weft 64 was desized, scoured, bleached and printed with the following printing recipes, using reactive colour:

| | A | B |
|---|---|---|
| 1. Thickner (sodium alginate paste 6 p.c.) | 40 | 40 parts |
| 2. Urea | 10 | 10 parts |
| 3. Polyethylene glycol 200 | Nil | 5 parts |
| 4. Resist Salt G | 1 | 1 parts |
| 5. Ekaline FFS (of Sandoz Ltd) | 1 | 1 parts |
| 6. Procion Red $H_8B$ (of I. C. I. England) | 5 | 5 parts |
| 7. Water | rest to make | 100 parts |

Sodium bicarbonate (2 parts) is added to the above pastes at the time of printing.

After printing and drying, the fabric was subjected to wet steaming and then washed off as usual. Diffused print effect was observed in sample B in both warp and weft directions of the fabric.

We claim:

1. A process for imparting a diffused print effect on printing polyester or polyester blended or mixed fabrics, the steps for imparting a diffused print effect thereto consisting of pure or blended spun polyester yarn at least in the warp or weft, printing the said fabric with a printing paste containing at least a known disperse dyestuff for polyester only, a known thickening agent and an auxiliary agent having a capillary action and further also capable of dissolving part of the dyestuff, said auxiliary agent selected from the group consisting of polyethylene glycol of 200 to 400 molecular weight, 2-anilino-ethanol, dibutyl butyl phosphonate, oleic acid or diethylene glycol alone or in any combination, said step of printing causing a reversal of the normal capillary action of the auxiliary agent, drying said fabric and, thereafter, activating the capillary action of said auxiliary agent and simultaneously fixing the dye to the fabric by wet high pressure steaming followed by the usual washing whereby to provide the diffused print effect on the fabric.

2. A process for imparting a diffused print effect on printing cellulosic fabrics, the steps for imparting a diffused print effect thereto consisting of printing the cellulosic fabrics with a printing paste containing known reactive dyestuff for cellulosic fibres, a known thickening agent and a auxiliary agent having a capillary action and further also capable of dissolving a part of the dyestuff, said auxiliary agent selected from the group consisting of polyethylene glycol of 200 to 400 molecular weight, 2-anilino-ethanol, dibutyl butyl phosphonate, oleic acid or diethylene glycol alone or in combination, said step of printing causing a reversal of the normal capillary action of the auxiliary agent, drying said fabric and, thereafter, activating the capillary action of said auxiliary agent and simultaneously fixing the dye to the fabric by wet high pressure steaming followed by the usual washing whereby to provide the diffused print on the fabric.

3. A process as claimed in claim 1 wherein the said printing paste contains a plurality of disperse dyes.

4. A process as claimed in claims 1 or 2 wherein said auxiliary agent is used at a concentration of at least 2.5 percent by weight of the printing paste.

5. A process as claimed in claims 1 or 2 wherein said oleic acid is used at a concentration of 8 to 12 percent by weight of the printing paste.

6. A process as claimed in claims 1 or 2 wherein polyethylene glycol is used at a concentration of 5 to 10 percent by weight of the printing paste.

7. A process as claimed in claims 1 or 2 wherein concentration of either dibutyl butyl phosphonate or 2-anilino ethanol is used at a concentration of 5 to 10 percent by weight of the printing paste.

8. A process as claimed in claims 1 or 2 wherein the said polyethylene glycol is used at a concentration of 5 to 10 percent by weight of the printing paste.

9. A process as claimed in claim 8 wherein the said polyethylene glycol is used at a concentration of 10 percent by weight of the printing paste.

10. A process as claimed in claim 8 wherein said polyethylene glycol has a molecular weight 400.

11. A process as claimed in claim 1 wherein the said fabric consists of a polyester-cellulosic blend in both warp and weft or at least in warp or weft and in the other polyester spun or filament.

12. A process as claimed in claim 11 wherein the said fabric is first printed with the printing paste having said auxiliary agent, drying, wet-steaming the fabric in a high pressure steamer, said fabric then being subjected to a step of removal of the cellulosic fibres from the fabric and then washed in a known manner.

13. A process as claimed in claim 1 wherein the said fabric consist of spun polyester yarn blended with cotton, silk, viscose or wool in either warp or weft of the fabric.

14. A process as claimed in claim 1 wherein the said fabric consists of a polyester cellulosic blend in both warp and weft or least in warp or weft and in the other polyester spun or filament, said printing paste including a known reactive dyestuff for said cellulosic fibres.

15. A process as claimed in claim 1 wherein the said controlled diffused print effect is in the direction of the spun yarn.

* * * * *